US011121475B2

(12) United States Patent
Yang et al.

(10) Patent No.: US 11,121,475 B2
(45) Date of Patent: Sep. 14, 2021

(54) PHASED ARRAY ANTENNA

(71) Applicant: Gapwaves AB, Göteborg (SE)

(72) Inventors: Jian Yang, Mölndal (SE); Thomas Emanuelsson, Gothenburg (SE); Ashraf Uz Zaman, Hisings-Backa (SE)

(73) Assignee: GAPWAVES AB, Gothenburg (SE)

( * ) Notice: Subject to any disclaimer, the term of this patent is extended or adjusted under 35 U.S.C. 154(b) by 0 days.

(21) Appl. No.: 16/646,282

(22) PCT Filed: Sep. 24, 2018

(86) PCT No.: PCT/EP2018/075791
§ 371 (c)(1),
(2) Date: Mar. 11, 2020

(87) PCT Pub. No.: WO2019/057965
PCT Pub. Date: Mar. 28, 2019

(65) Prior Publication Data

US 2020/0287291 A1 Sep. 10, 2020

(30) Foreign Application Priority Data

Sep. 25, 2017 (EP) ..... 17192899

(51) Int. Cl.
*H01Q 21/00* (2006.01)
*H01Q 21/06* (2006.01)
(Continued)

(52) U.S. Cl.
CPC ..... *H01Q 21/062* (2013.01); *H01Q 1/523* (2013.01); *H01Q 9/28* (2013.01); *H01Q 21/005* (2013.01)

(58) Field of Classification Search
CPC ..... H01Q 21/062; H01Q 1/523; H01Q 9/28; H01Q 21/064; H01Q 21/0037;
(Continued)

(56) References Cited

U.S. PATENT DOCUMENTS 9,865,935 B2 * 1/2018 Miraftab ..... H01Q 21/005
10,312,601 B2 * 6/2019 Zhai ..... H01Q 13/06
(Continued)

FOREIGN PATENT DOCUMENTS

WO 2010003808 A2 1/2010
WO 2013189919 A1 12/2013
(Continued)

OTHER PUBLICATIONS

Alos, E. A. et al., "Ka-Band Gap Waveguide Coupled-Resonator Filter for Radio Link Diplexer Application", IEEE Transactions on Components, Packaging and Manufacturing Technology, vol. 3, No. 5, pp. 870-879, May 1, 2013, XP011511443.
(Continued)

*Primary Examiner* — Vibol Tan
(74) *Attorney, Agent, or Firm* — Buchanan Ingersoll & Rooney P.C.

(57) ABSTRACT

A phased array is disclosed, including: a base layer including a substrate with a plurality of protruding posts, for stopping wave propagation along the base layer, and a printed circuit board (PCB) arranged on the base layer, and including at least one phased array radio frequency (RF) integrated circuit (IC) on a first side of the PCB facing the base layer and the protruding posts. The PCB further includes feeds for transferring of RF signals from the phased array RF IC(s) to an opposite second side of the PCB. A radiating layer, including a plurality of radiating elements for transmitting and/or receiving RF signals from the phased array antenna is also provided, together with a feeding layer for transfer of RF signals, arranged between the feeds of the PCB on the second side and the radiating elements of the radiating layer.

18 Claims, 5 Drawing Sheets

(51) Int. Cl.
*H01Q 1/52* (2006.01)
*H01Q 9/28* (2006.01)

(58) Field of Classification Search
CPC .. H01Q 21/005; H01Q 21/00; H01Q 21/0043; H01P 1/211
See application file for complete search history.

(56) References Cited

U.S. PATENT DOCUMENTS

| | | | | |
|---|---|---|---|---|
| 10,498,000 | B2 * | 12/2019 | Hadavy | B21K 23/00 |
| 2011/0181373 | A1 | 7/2011 | Kildal | |
| 2015/0194718 | A1 | 7/2015 | Kildal et al. | |
| 2015/0380826 | A1 | 12/2015 | Yang et al. | |
| 2016/0204514 | A1 * | 7/2016 | Miraftab | H01Q 21/005 343/737 |
| 2017/0084971 | A1 | 3/2017 | Kildal et al. | |
| 2017/0187124 | A1 | 6/2017 | Kirino et al. | |
| 2018/0026378 | A1 | 1/2018 | Hadavy et al. | |
| 2018/0269557 | A1 | 9/2018 | Fangfang et al. | |
| 2018/0337461 | A1 | 11/2018 | Kildal et al. | |
| 2019/0081412 | A1 | 3/2019 | Hügel et al. | |

FOREIGN PATENT DOCUMENTS

| | | | |
|---|---|---|---|
| WO | 2014062112 | A1 | 4/2014 |
| WO | 2015172948 | A2 | 11/2015 |
| WO | 2016058627 | A1 | 4/2016 |
| WO | 2016116126 | A1 | 7/2016 |
| WO | 2017050817 | A1 | 3/2017 |
| WO | 2017052441 | A1 | 3/2017 |
| WO | 2017086853 | A1 | 5/2017 |
| WO | 2017086855 | A1 | 5/2017 |
| WO | 2017158020 | A1 | 9/2017 |

OTHER PUBLICATIONS

International Search Report (PCT/ISA/210) dated Dec. 13, 2018, by the European Patent Office as the International Searching Authority for International Application No. PCT/EP2018/075791.
Written Opinion (PCT/ISA/237) dated Dec. 13, 2018, by the European Patent Office as the International Searching Authority for International Application No. PCT/EP2018/075791.

* cited by examiner

PHASED ARRAY ANTENNA

TECHNICAL FIELD OF THE INVENTION

The present invention is related to a phased array antenna, and in particular to a 2D massive MIMO, beam steering antenna. More specifically, the present invention is related to an RF/microwave/millimetre wave antenna having integrated electronics for beam control and transmit/receive functionality. Typical application areas for the antenna are telecommunication, automotive radar, radar for military or satellite applications.

BACKGROUND

Phased array antennas have been developed since late 1960's for mainly military radar applications. As the integration level of all electronics, also at millimetre wave frequencies, has increased enormously since then, the possibility to build affordable phased array antennas have reached cost levels that are suitable also for commercial applications. The existing systems are built in two principally different ways usually called "brick" and "tile", respectively.

The brick system is using transmit/receive modules mounted perpendicular to the antenna plane which in a simplified way increases available space for the electronics and increases the cooling possibilities. The big problem in the brick building practice is the connection to the antenna that usually is made through coaxial connectors that are expensive, bulky and susceptible for tolerances. Thus, this way of building is only used in high cost, high performance military radar systems.

The tile building practice seems ideal because of the easier way that the antenna is integrated with the electronics due to no perpendicular antenna connections. However, also in this way of building the antenna several drawbacks exist. The main issues are the limited available space for the electronics due to the requirement to have a maximum distance between adjacent antenna elements of half a wavelength (for example 5 mm at 30 GHz), the need for shielding walls for isolation between the channels, the limited room for adding filtering in the transmit/receive path, the thermal limitations due to high power per area unit when electronics are tightly crowded, etc. These limitations or boundary conditions limits the use of tile antennas to low power devices without filtering and limited scan range.

There is therefore a need for a new phased array antenna which can be produced relatively cost-effectively, and which alleviates at least some of the above-discussed problems.

SUMMARY OF THE INVENTION

The object of the present invention is therefore to provide a new phased array antenna which can be produced relatively cost-effectively, and which alleviates at least some of the above-discussed problems.

This object is achieved by a phased array antenna in accordance with the appended claims.

According to a first aspect of the present invention, there is provided a phased array antenna comprising:

a base layer comprising a substrate with a plurality of protruding posts, said posts for stopping wave propagation along said base layer;

a printed circuit board (PCB) arranged on said base layer, and comprising at least one phased array radio frequency (RF) integrated circuit (IC) on a first side of the PCB facing the base layer and the protruding posts, the PCB further comprising feeds for transferring of RF signals from the phased array RF IC(s) to an opposite second side of the PCB;

a radiating layer, comprising a plurality of radiating elements for transmitting and/or receiving RF signals from the phased array antenna; and a feeding layer for transfer of RF signals, arranged between the feeds of the PCB on the second side and the radiating elements of the radiating layer.

The new phased array antenna solves a number of the inherent problems previously experienced in the tile antenna building practice by using one or several layers of gap waveguide technology.

Put differently, the invention provides a new antenna including a low loss multilayer gap waveguide structure and including a board for microwave/millimeterwave components with efficient electrical coupling and built-in high efficiency thermal path for cooling of electronics. The gap post/pin technology is suppressing propagation in or between channels in the antenna.

The electronics, i.e. at least one phased array radio frequency (RF) integrated circuit (IC), is mounted on a PCB, such as a microstrip board, which couples to the feeding structure on the other side of the PCB. The very efficient feed is enabled by the base layer with the protruding posts, supressing wave propagation along the baser layer. Thus, the protruding posts form a gap Artificial Magnetic Conductor (AMC) surface. The base layer with the protruding posts preferably covers the complete area of the PCB. The effect of this base layer is a total suppression of any wave propagation along or inside the PCB which leads to the great advantage that all shielding walls that are otherwise always present to decouple adjacent channels can be omitted thus enabling a very efficient use of the PCB area. This also minimizes the routing problems in the board.

The gap waveguide structures, i.e. the structures including the protruding posts, are preferably comprising a metal surface, and are most preferably made entirely by metal. For example, the structures can be manufactured by die-casting or injection moulding, e.g. using aluminium or zinc.

The base layer with the protruding posts also, in particular when made of metal, leads to another great advantage in that the microwave circuitry that is mounted on the PCT will have a very effective thermal path away from the board, and thereby an efficient cooling of the antenna. This leads to very high power handling capability which in turn enables higher output power from the antenna. This is of great importance for example in a telecommunication system or a radar system. The base layer with the protruding posts will also function as a cooling surface for circuits that need cooling from top side e.g. BGA packaged CMOS circuits commonly used for the low power and digital parts of the system.

The use of protruding posts to form a surface supressing wave from propagating in unwanted directions is per se known from inter alia WO 10/003808, WO 13/189919, WO 15/172948, WO 16/058627, WO 16/116126, WO 17/050817 and WO 17/052441, all by the same applicant, and each of said documents hereby being incorporated in their entirety by reference.

The use of protruding posts to form suppression of waves in unwanted directions may be referred to as gap waveguide technology, which is a technology used to control wave propagation in the narrow gap between parallel conducting plates, or to form surfaces suppressing wave propagation. The wave propagation is stopped by using periodic elements such as metal posts (also referred to as pins) in one or both of two parallel conductive surfaces, and in case a waveguide is to be formed, the waves are guided along e.g. metal ridges, arranged on one of the two conducting surfaces. No metal connections between the two parallel conductive surfaces are needed. The fields are mainly present inside the gap between the two surfaces, and not in the texture or layer structure itself, so the losses are small. This type of microwave waveguide technology is particularly advantageous for frequency so high that existing transmission lines and waveguides have too high losses or cannot be manufactured cost-effectively within the tolerances required.

The radiating elements may be slot openings extending through the radiating layer, and preferably rectangular slot openings. The slot openings are preferably relatively short, and arranged along parallel lines in the radiating layer, each line comprising a plurality of slot openings. However, longer slot openings may also be used, such as slot openings extending over almost the entire width of the radiating layer.

Instead of the above-discussed slot openings in the radiating layer, other radiating elements may also be used, such as radiating patches and the like.

In accordance with one line of embodiments, the radiating elements are bow-tie antennas. Bow-tie antennas are very efficient and are also cost-efficient to produce. Bow-tie antennas are per se known from e.g. WO 14/062112, WO 17/086853 and WO 17/086855, all by the same applicant, and each of said documents hereby being incorporated in their entirety by reference.

The feeding layer may be a gap waveguide layer, comprising gap waveguides for transferring of RF signals between the feeds of the PCB and the radiating elements. Such gap waveguides are, as said above, per se known inter alia from WO 10/003808, WO 13/189919, WO 15/172948, WO 16/058627, WO 16/116126 and WO 17/050817, all by the same applicant, and each of said documents hereby being incorporated in their entirety by reference. The use of gap waveguides in the feeding layer provides additional surprising advantages. Gap waveguides enables a combination of low loss and very low manufacturing cost. Here, the electronics mounted on the PCB may couple to the gap waveguides e.g. from an open end microstrip line in a slot opening. Thus, the feeds of the PCB can be through holes connected to corresponding openings in the gap waveguide layer, the through holes of the PCB being fed by microstrip lines on the first side of the PCB. A very efficient coupling is then enabled by the previously discussed base layer with the protruding posts, which effectively forces the field into the slot thus avoiding the very space consuming quarter wavelength short that other solutions are required to use.

Further, the microwave circuitry that is mounted on the PCB will hereby, thanks to the gap waveguide layer, have also an additional very effective thermal path, directly at the groundside of the PCB, leading to even higher power handling capability which in turn enables even higher output power from the antenna. This effect is particularly pronounced when the gap waveguide structure is made of metal.

The use of the gap waveguide feeding layer also enables incorporation of low loss filters in the transmit/receive path, e.g. by adding an extra layer of gap waveguide structure between the PCB and the feeding layer. Filtering is often a crucial function in e.g. a telecommunication system for suppressing noise and interferers, and which is very difficult to incorporate with low losses in other building practices, such as in microstrip or stripline substrates.

The gap waveguide layer, i.e. the feeding layer with the gap waveguides, preferably comprises a ridge feeding structure surrounded by protruding posts arranged to stop wave propagation in other directions than along said ridge.

At least one, and preferably both, of the base layer and the feeding layer, in particular when incorporating gap waveguides, is/are made of metal, and preferably aluminium.

In at least one, and preferably both, of the base layer and the feeding layer with gap waveguides, the protruding posts have a maximum cross-sectional dimensions of less than half a wavelength in air at the operating frequency, and/or a spacing between the protruding posts being smaller than half a wavelength in air at the operating frequency. Further, the protruding posts are preferably arranged in a periodic or quasi-periodic pattern and fixedly connected to the base layer/feeding layer. Preferably, the protruding posts are connected electrically to each other at their bases at least via said base layer/feeding layer.

To improve the thermal paths, at least some, and preferably all, of the protruding posts can be arranged in mechanical contact with the printed circuit board. However, alternatively the PCB may be separated from the protruding posts by a short separation gap. Further, the base layer may have an extension sufficient to cover the complete area of the PCB. Still further, the base layer may be formed of metal, and preferably aluminium.

In one embodiment, the antenna further comprises a filter layer arranged between the PCB and the feed layer. The filter layer may be realized as a second gap waveguide layer forming resonant cavities.

Preferably, all the layers of the antenna have essentially the same width and length dimensions. Hereby, a compact antenna is provided, and with excellent shielding and heat dissipation properties. However, it is also possible to have some layers being somewhat larger than the others, such as e.g. the radiating layer and/or the base layer.

Further embodiments and advantages of the present invention will become apparent from the following detailed description of presently preferred embodiments of the invention.

BRIEF DESCRIPTION OF THE DRAWINGS

For exemplifying purposes, the invention will be described in closer detail in the following with reference to embodiments thereof illustrated in the attached drawings, wherein:

FIG. 3 is a detailed sectional view of a part of an antenna in accordance with an embodiment of the invention forming a transition from the PCB layer to a gap waveguide feeding layer, with a filter layer there between;

DETAILED DESCRIPTION

Figure 1:
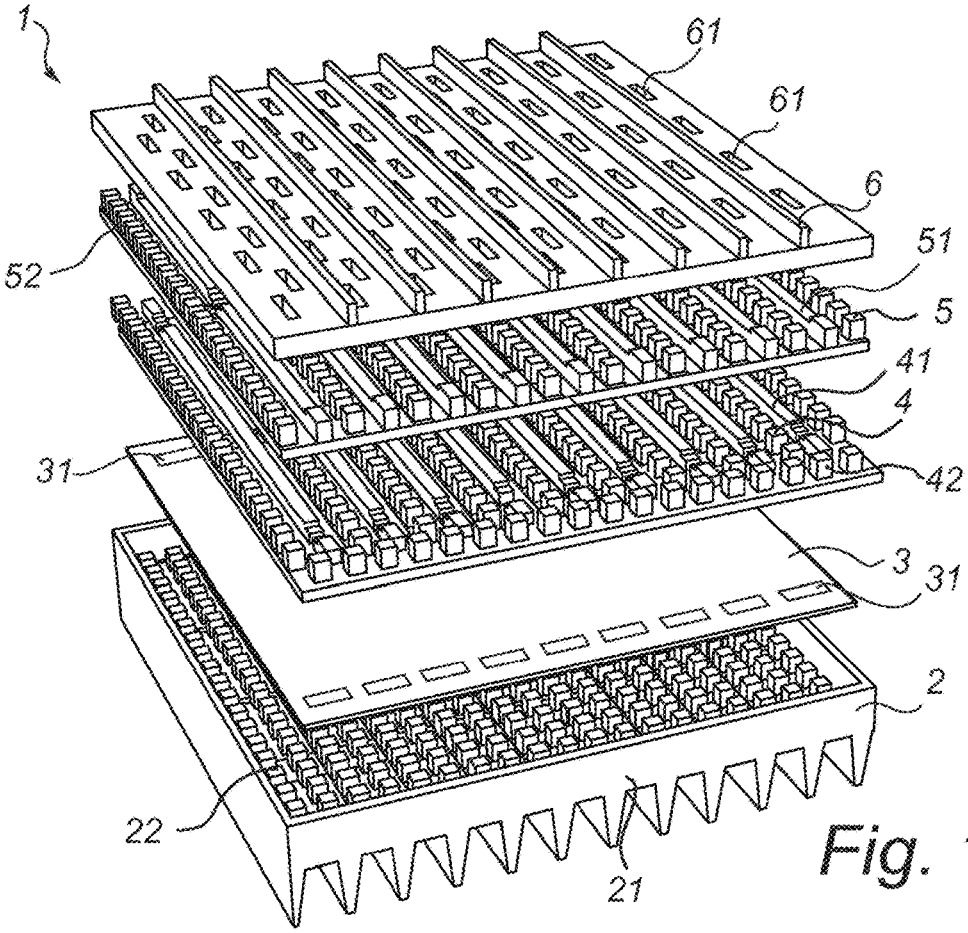
FIG. 1 is an exploded view of a phased array antenna in accordance with an embodiment of the present invention.

With reference to FIG. 1, a phased array antenna 1 according to a first embodiment comprises a baser layer 2. The base layer comprises a substrate 21 with a plurality of protruding posts 22, for stopping wave propagation along the base layer. The protruding posts may be arranged in a periodic or quasi-periodic pattern, and preferably have maximum cross-sectional dimensions of less than half a wavelength in air at the operating frequency, and a spacing between the protruding posts which is smaller than half a wavelength in air at the operating frequency. The protruding posts are fixedly connected to the substrate, and are also electrically connected to each other via said substrate. The substrate and the protruding posts have a conductive metal surface, and are preferably made entirely by metal. For example, the base layer could be die casted or injection molded of aluminium or zinc. The protruding posts 22 can e.g. have a rectangular or circular cross-sectional shape.

A printed circuit board (PCB) 3 is arranged on the base layer. The PCB preferably comprises one side, a component side, comprising electronic components, and more specifically at least one phased array radio frequency (RF) integrated circuit (IC), and another side comprising a ground layer. The component side is here arranged towards the base layer and the protruding posts.

The PCB further comprises feeds 31 for transferring of RF signals from the phased array RF IC(s) to the opposite side of the PCB. Here, the feeds comprise slot openings through the PCB. The electronics mounted on the PCB couples to the slot openings e.g. from open end microstrip lines extending into the slot openings.

An optional filter layer 4 may be arranged on the PCB layer 3. The filter preferably provides low loss waveguide filtering. The filter layer may comprise gap waveguides, forming resonant cavities to filter the electromagnetic waves. The gap waveguides may be realized as ridges 41 surrounded by protruding posts 42 for stopping or suppressing waves in other directions than the intended, in the same way as discussed in the foregoing.

A feeding layer 5 is arranged on the filter layer 4, or directly on the PCB 3, if the filter layer is omitted. The feeding layer 5 comprises to transfer RF signals coming from the feeds of the PCB, possibly via the optional filter layer, to radiating elements of a radiating layer, or in the reverse way. In this embodiment, the feeding layer is realized as a gap waveguide structure, comprising ridges 51 along which the signals are to propagate, and protruding posts 52 arranged to stop or suppress wave propagation in other directions, in the same way as discussed in the foregoing. The protruding posts are preferably arranged in at least two parallel rows on both sides along each waveguiding path. However, for some applications, a single row may suffice. Further, more than two parallel rows may also advantageously be used in many embodiments, such as three, four or more parallel rows.

The feeds 31 of the PCB layer, and the corresponding openings/inputs in the feeding layer 5, or in the filter layer 4 in case such a layer is provided, may be arranged along two lines, arranged close to two opposing sides of the PCB. This will feed signals in parallel lines in the feeding layer, from the sides of the feeding layer and towards the centre. However, alternatively the feeds may be arranged along one or more centre lines, or one or several lines arranged relatively close to the centre. This will feed signals in parallel lines in the feeding layer from the centre and outwards, towards the sides. It is also possible to provide three or four parallel lines of feeds 31, arranged separated and distributed over the PCB. However, other arrangements of the feeds are also feasible.

A radiating layer 6 is arranged on the feeding layer 5, and comprises a plurality of radiating elements 61, arranged as an array. The radiating elements are arranged to transmit and/or receive RF signals. The radiating layer preferably forms a planar radiating surface.

In this embodiment, the radiating elements are slot openings extending through the radiating layer, and arranged to be coupled to the gap waveguides of the feeding layer 5. The slot openings are preferably relatively short, and arranged along parallel lines in the radiating layer, each line comprising a plurality of slot openings.

The spacing between the antenna elements, e.g. in the form of slots, is preferably smaller than one wavelength in air at the operational frequency.

Figure 2:
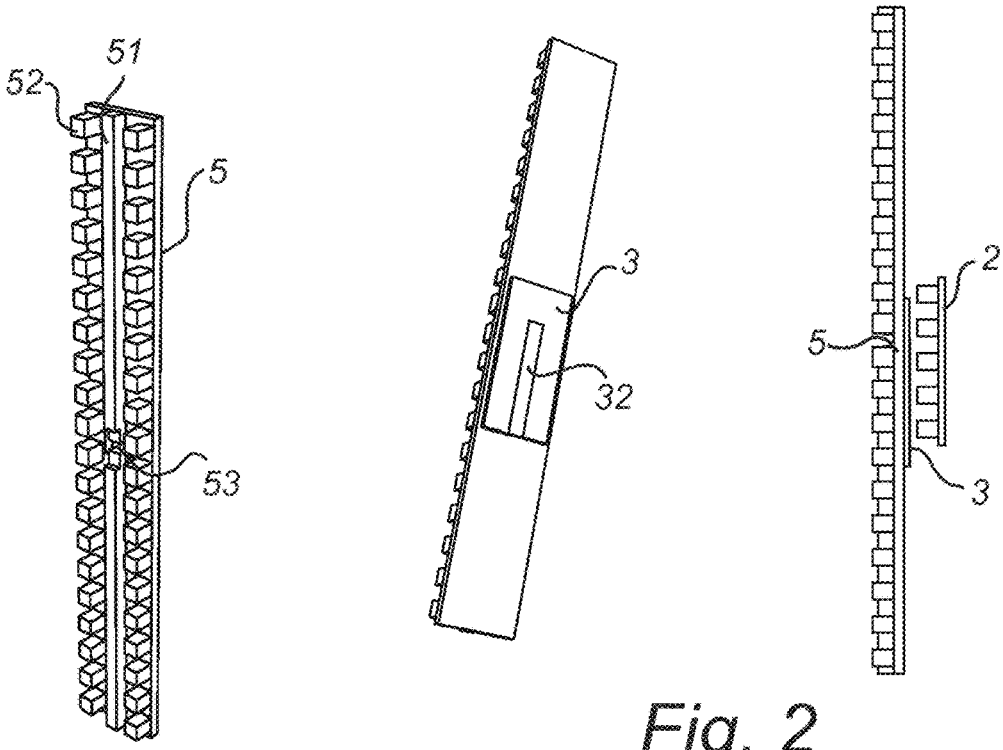
FIG. 2 are detailed views, seen from different directions, of a part of an antenna in accordance with an embodiment of the invention forming a transition from the PCB layer to a gap waveguide feeding layer.

In FIG. 2, the transition from the PCB layer to a gap waveguide feeding layer is illustrated in more detail. The gap waveguide comprises ridges 51, forming propagation paths for the waves, and being surrounded by protruding posts 52. The waves are fed through an opening 53 in the substrate. The opening 53 is coupled to an open end of a microstrip line 32 on the PCB 3. Further, a base layer 2 with protruding pins is arranged on the other side of the PCB. In FIG. 2, only small parts of the base layer 2 and the PCB are shown.

Figure 3:
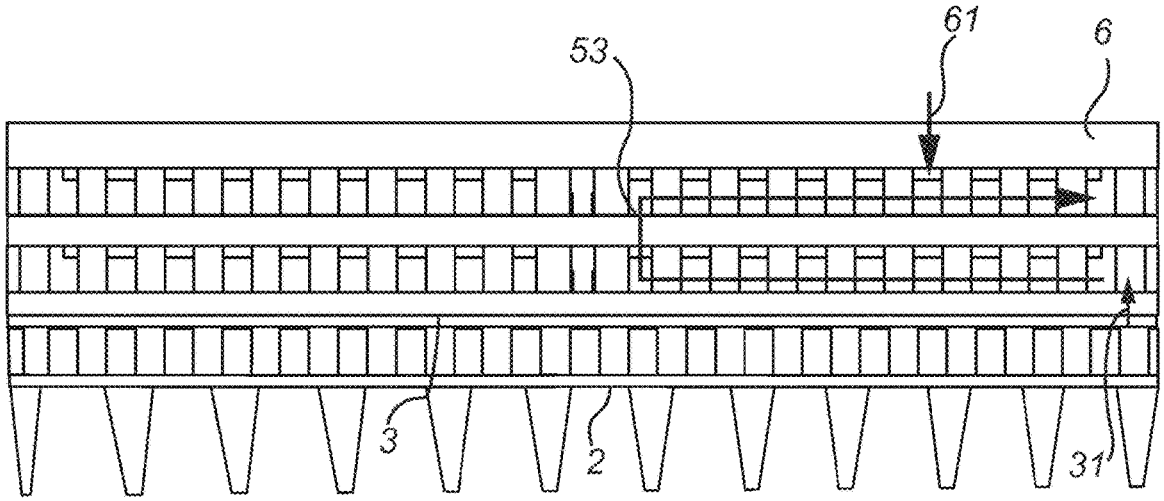

In case a filter layer 4 is used, as discussed above, the feeding into the filter layer can be made in the same way. This is illustrated in FIG. 3, showing feeding of signals/waves from the PCB 3 into the filter layer. The feeding here occurs on the side of the PCB 3, at the openings 31. The signal/wave then propagates along the ridge gap waveguide, and is then transferred via opening 53 into the ridge gap waveguides of the feeding layer 5. Here, the signals/waves are guided towards the slot openings 61 of the antenna layer 6. This described signal propagation is for transmitting signals from the antenna. For receiving signals, the same path is followed, but in the reverse order and direction.

The phased array RF IC(s) preferably comprises a plurality of phase controlled feeds, and/or amplitude controlled feeds. The phased array RF IC(s) may be arranged to provide signals having different phases/amplitudes to one or several of the antenna elements of the radiating layer, thereby providing beam steering in a per se known manner. The phased array RF IC(s) may e.g. be arranged to control the phases of antenna elements arranged in different columns or lines separately, to provide beam steering in one direction. However, it may alternatively be arranged to control antenna elements of sections distributed both in the width and length direction of the radiating layer separately, to provide beam steering in two orthogonal directions. It may also be arranged to control every antenna element separately.

Figure 4:
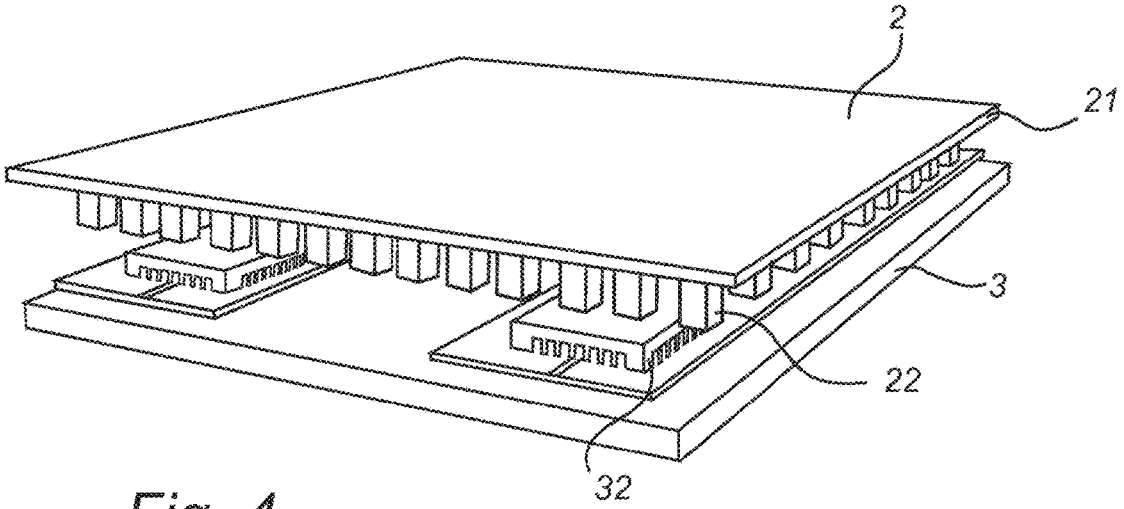
FIG. 4 is a detailed perspective view of a PCB layer and a base layer in accordance with an embodiment of the invention.

As best seen in FIG. 4, the protruding posts 22 of the base layer 2 are arranged overlying/underlying the active parts of the PCB 3. The protruding posts 22 may be arranged at a small distance from the PCB and the components thereon. However, alternatively, the protruding posts may be arranged in direct contact with the PCB and/or the components 32 provided on the PCB, thereby making heat dissipation more efficient.

The protruding posts may all have the same heights. It is also possible to use protruding pins of somewhat different height. For example, the protruding posts directly overlying/underlying the components 32 may have a lower height. Hereby, recessed areas may be formed in the surface presented by the protruding posts, in which the integrated circuits or the like are inserted.

Figure 5:
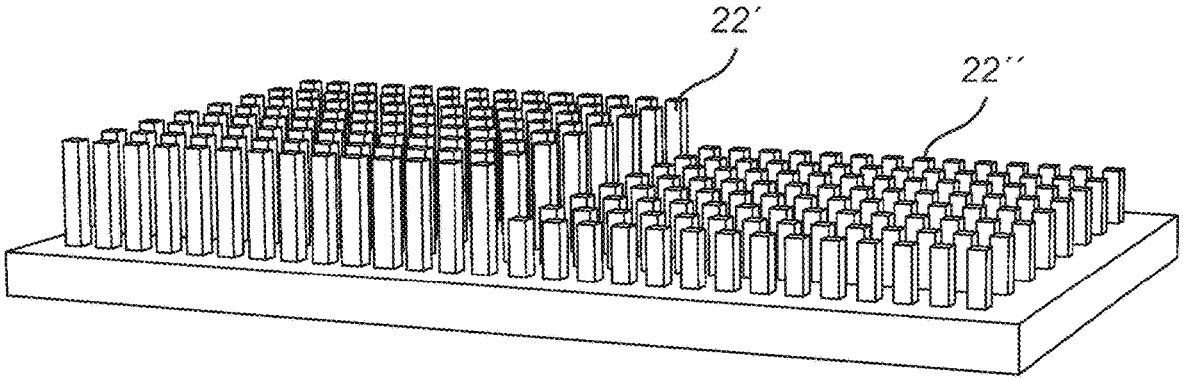
FIG. 5 is a detailed perspective view of the base layer in accordance with another embodiment of the invention.

It is also possible to have protruding posts of varying heights in different sections of the base layer. Such an embodiment is schematically illustrated in FIG. 5. Here, the protruding posts 22' of a first section are higher than the protruding posts 22" of another section. This embodiment is useful for example when signals of different frequencies are used on different parts of the PCB, thereby making the shielding of each part more efficient.

Instead of the above-discussed slot openings in the radiating layer, other radiating elements may also be used, such as radiating patches and the like.

In accordance with one line of embodiments, the radiating elements are bow-tie antennas. Bow-tie antennas are very efficient and are also cost-efficient to produce. Bow-tie antennas are per se known from e.g. WO 14/062112, WO 17/086853 and WO 17/086855, all by the same applicant, and each of said documents hereby being incorporated in their entirety by reference.

The bow-tie antenna is a self-grounded antenna, arranged on a ground plane. This ground plane further enhances the thermal dissipation of the antenna. Bow-tie antennas are known to be easy and cost-efficient to produce, and are small and compact.

Figure 6:
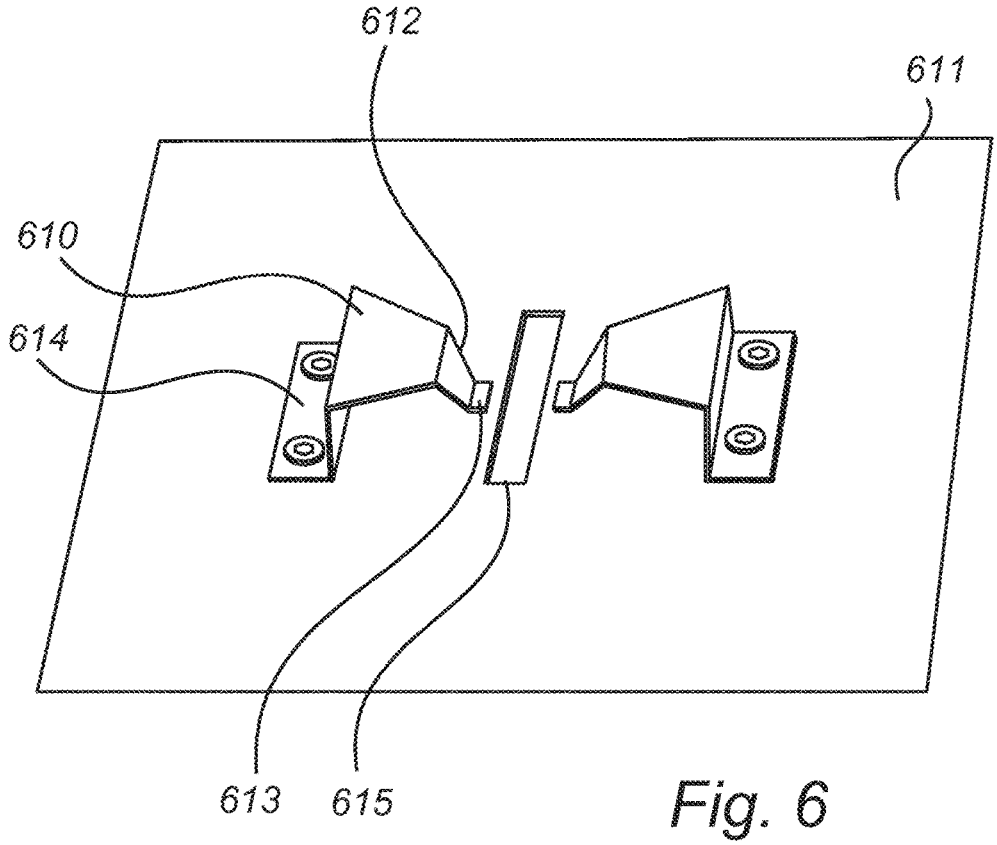
FIG. 6 is a detailed perspective view from above of a bow-tie antenna for use in an embodiment of the present invention.

As illustrated in FIG. 6, each bow-tie antenna element may comprise a number of antenna petals 610, arranged on a ground plane 611. The ground plane 611 may be a common ground plane for all the antenna elements in the array of antennas. Preferably, two or four antenna petals are provided, and arranged in a symmetrical fashion around a feed. Each antenna petal comprises an arm section 612 tapering towards the central end portions 613, and are made of an electrically conducting material. From the central end portions, each antenna petal extends in a bow to a wider outer end 614, which is connected to the ground plane 611.

The central end portions 613 may be conductively connected to the ground plane 611, and be arranged in the vicinity of an antenna feed, e.g. in the form of an opening 615. Hereby, the antenna petals resemble the function of a so-called TEM horn. This type of bow-tie antenna is e.g. discussed in WO 2017/086855. The openings 615 may be coupled to openings in the feeding layer, in a similar way as for the previously discussed antenna elements in the form of slot openings.

Figure 7:
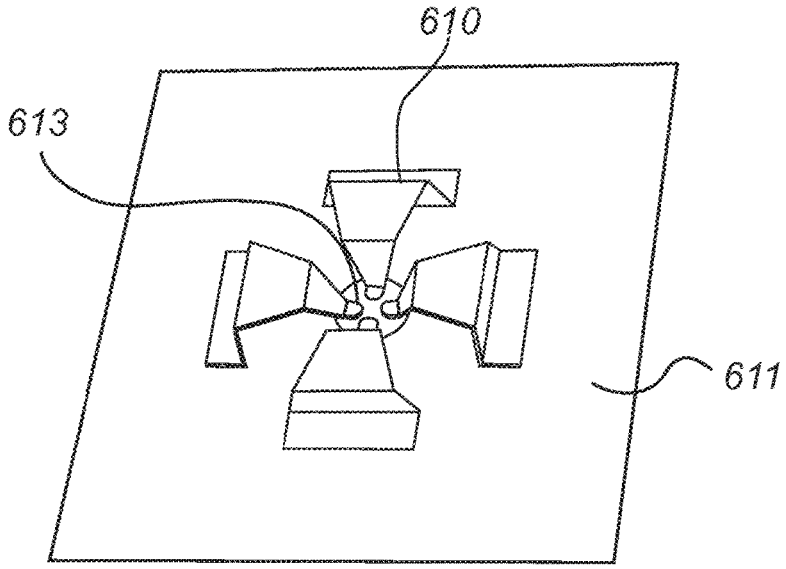
FIG. 7 is a detailed perspective view from above of a bow-tie antenna for use in another embodiment of the present invention.

In an alternative embodiment, as shown in FIG. 7, the central end portion of each antenna petal is connected to one or several antenna feeds. In particular, the end portions may have an end tip portion being adapted to be connected to feeding ports, a specific port being provided for each antenna petal. This type of bow-tie antenna is e.g. discussed in WO 2014/062112, and also in WO 2017/086855.

Figure 8:
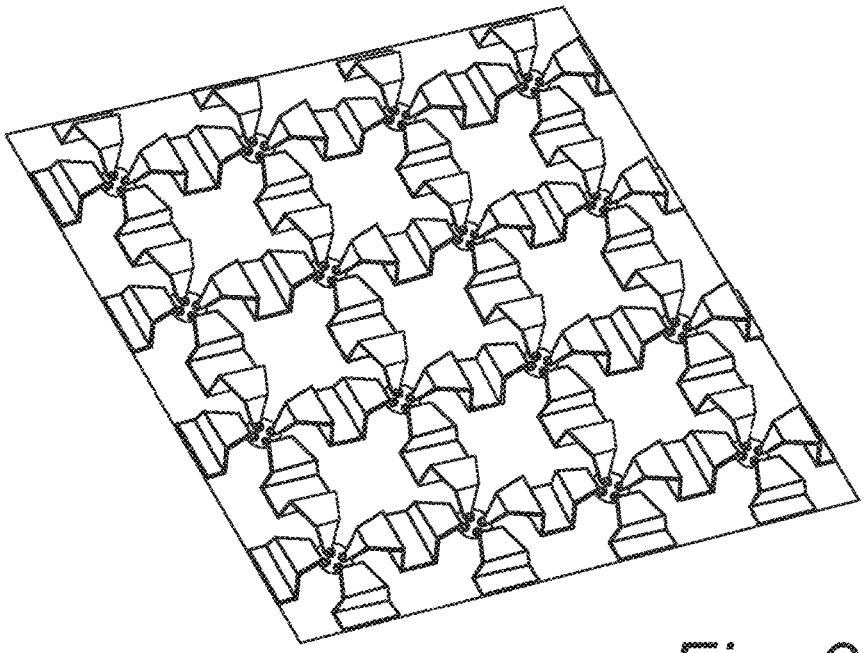
FIG. 8 is a detailed perspective view from above of an array of bow-tie antennas for use in an embodiment of the present invention.

The bow-tie antennas, regardless of whether of the first or second type, may be arranged as an array of antenna elements on the surface of the radiating layer, as illustrated in FIG. 8.

For the second type of bow-tie antenna, as discussed above in relation to FIG. 7, the feeding structure of the phased array antenna may be somewhat different. In this case, conductive lines, e.g. in the form of via-holes, coaxial cables or the like, may be arranged through the feeding layer to connect the feed outputs from the PCB layer with the feed inputs of the radiating layer.

Figure 9:
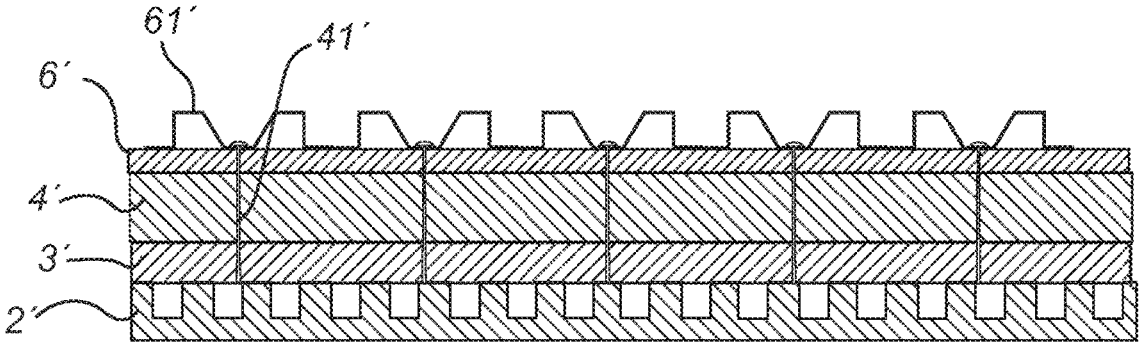
FIG. 9 is a schematic sectional view of another embodiment of the antenna in accordance with the invention.

Such an embodiment is schematically illustrated in FIG. 9. Here, the radiating layer 6' comprises an array of antenna elements 61' in the form of bow-tie antennas of the type discussed in relation to FIG. 7, and as shown in FIG. 8. The PCB layer 3' comprises feed outputs, which are connected to conducting lines 41' leading through the feeding layer 4'. The feeding layer may e.g. be formed as a metal layer, such as an aluminium layer, and with coaxial connecting lines being arranged in through holes of the metal layer.

It is also possible to provide an optional filter layer between the feeding layer and the PCB layer, in a similar way as in the above-discussed embodiments.

On the other side of the PCB layer 3', a base layer 2 having protruding posts is arranged, and the base layer may here be structured in the same way as in the previously discussed embodiments, and perform the same function.

The above-discussed embodiments of phased array antennas have very good performance, and may operate up to very high frequencies. The antenna is preferably adapted for use at high frequencies. In particular, it is preferred that it is adapted for use at a frequency/wave region of operation at frequencies above 300 MHz, and preferably above 1 GHz. It may also be used at even higher frequencies, such as exceeding 10 GHz, exceeding 20 GHz, or exceeding 30 GHz, or exceeding 100 GHz. In particular, the first discussed embodiments, discussed in relation to FIG. 1, may operate at frequencies above 10 GHz, whereas the later discussed embodiments, discussed in relation to FIG. 9, may operate at least up to 6 GHz.

Further, the phased array antenna may be used as a stand-alone antenna. However, it may also be integrated with other components. It is also possible to assemble a plurality of phased array antenna of the above-discussed type together into a larger array and synchronized from a common source, to provide more power.

The antenna of the present invention may be used for either transmission or reception of electromagnetic waves, or both.

The antenna is preferably flat, and with an essentially rectangular shape. However, other shapes are also feasible, such as circular, oval are also feasible. The shape may also be in the form of a hexagon, octagon or other polygons. The antenna surface may also be non-planar, such as being convex in shape.

The waveguides of the antenna and/or the space between the protruding posts may be filled with a dielectric material, such as dielectric foam, for mechanical reasons. However, preferably at least some, and preferably all, the waveguides and/or all the space between the protruding posts are filled with air, and free from dielectric material.

The protruding posts may have any cross-sectional shape, but preferably have a square, rectangular or circular cross-sectional shape. Further, the protruding posts preferably have maximum cross-sectional dimensions of smaller than half a wavelength in air at the operating frequency. Preferably, the maximum dimension is much smaller than this. The maximum cross-sectional dimension is the diameter in case of a circular cross-section, or diagonal in case of a square or rectangular cross-section. The plurality of protruding posts may also be referred to as a pin grid array.

The protruding posts are all preferably fixed and electrically connected to one conductive surface. However, at least some, and preferably all, of the protruding elements may further be in direct or indirect mechanical contact with the surface arrange overlying the protruding posts.

In addition to the above-discussed layers, the phased array antenna may also comprise additional layers, such as support layers, spacing layers etc, arranged above or below the previously discussed arrangement of layers, or between any of these layers. There may also be provided more than one PCB layers, e.g. arranged on top of each other, in a sandwiched construction, or arranged with other layers there between.

Such and other obvious modifications must be considered to be within the scope of the present invention, as it is defined by the appended claims. It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting to the claim. The word "comprising" does not exclude the presence of other elements or steps than those listed in the claim. The word "a" or "an" preceding an element does not exclude the presence of a plurality of such elements. Further, a single unit may perform the functions of several means recited in the claims.

The invention claimed is:

1. A phased array antenna comprising:

a base layer comprising a substrate with a plurality of protruding posts, said posts for stopping wave propagation along said base layer;

a printed circuit board (PCB) arranged on said base layer, and comprising at least one phased array radio frequency (RF) integrated circuit (IC) on a first side of the PCB facing the base layer and the protruding posts, the PCB further comprising feeds for transferring of RF signals from the phased array RF IC(s) to an opposite second side of the PCB;

a radiating layer, comprising a plurality of radiating elements for transmitting and/or receiving RF signals from the phased array antenna; and a feeding layer for transfer of RF signals, arranged between the feeds of the PCB on the second side and the radiating elements of the radiating layer, wherein the feeding layer is a gap waveguide layer, comprising gap waveguides for transferring of RF signals between the feeds of the PCB and the radiating elements.

2. The phased array antenna of claim 1, wherein the radiating elements are slot openings extending through the radiating layer.

3. The phased array antenna of claim 1, wherein the radiating elements are bow-tie antennas.

4. The phased array antenna of claim 1, wherein the feeds of the PCB are through holes connected to corresponding openings in the gap waveguide layer, the through holes of the PCB being fed by microstrip lines on the first side of the PCB.

5. The phased array antenna of claim 1, wherein the gap waveguide layer comprises a ridge feeding structure surrounded by protruding posts arranged to stop wave propagation in other directions than along said ridge.

6. The phased array antenna of claim 1, wherein the base layer has an extension sufficient to cover the complete area of the PCB.

7. The phased array antenna of claim 1, wherein the base layer is formed of metal.

8. The phased array antenna of claim 1, wherein the antenna further comprises a filter layer arranged between the PCB and the feed layer.

9. The phased array antenna of claim 8, wherein the filter layer is a second gap waveguide layer forming resonant cavities.

10. The phased array antenna of claim 1, wherein all the layers have essentially the same width and length dimensions.

11. The phased array antenna of claim 1, wherein the base layer is made of metal.

12. The phased array antenna of claim 1, wherein the protruding posts of the base layer have maximum cross-sectional dimensions of less than half a wavelength in air at the operating frequency, and/or wherein the protruding posts are spaced apart by a spacing being smaller than half a wavelength in air at the operating frequency.

13. The phased array antenna of claim 1, wherein the protruding posts of the base layer are arranged in a periodic or quasi-periodic pattern and fixedly connected to the base layer.

14. The phased array antenna of claim 1, wherein the protruding posts of the base layer are connected electrically to each other at their bases at least via said base layer.

15. The phased array antenna of claim 1, wherein at least some of the protruding posts are in mechanical contact with the printed circuit board.

16. A phased array antenna comprising:

a base layer comprising a substrate with a plurality of protruding posts, said posts for stopping wave propagation along said base layer;

a printed circuit board (PCB) arranged on said base layer, and comprising at least one phased array radio frequency (RF) integrated circuit (IC) on a first side of the PCB facing the base layer and the protruding posts, the PCB further comprising feeds for transferring of RF signals from the phased array RF IC(s) to an opposite second side of the PCB;

a radiating layer, comprising a plurality of radiating elements for transmitting and/or receiving RF signals from the phased array antenna; and a feeding layer for transfer of RF signals, arranged between the feeds of the PCB on the second side and the radiating elements of the radiating layer, wherein the antenna further comprises a filter layer arranged between the PCB and the feed layer.

17. The phased array antenna of claim 16, wherein the filter layer is a second gap waveguide layer forming resonant cavities.

18. A phased array antenna comprising:

a base layer comprising a substrate with a plurality of protruding posts, said posts for stopping wave propagation along said base layer;

a printed circuit board (PCB) arranged on said base layer, and comprising at least one phased array radio frequency (RF) integrated circuit (IC) on a first side of the PCB facing the base layer and the protruding posts, the PCB further comprising feeds for transferring of RF signals from the phased array RF IC(s) to an opposite second side of the PCB;

a radiating layer, comprising a plurality of radiating elements for transmitting and/or receiving RF signals from the phased array antenna; and a feeding layer for transfer of RF signals, arranged between the feeds of the PCB on the second side and the radiating elements of the radiating layer, wherein the protruding posts of the base layer have maximum cross-sectional dimensions of less than half a wavelength in air at the operating frequency, and/or wherein the protruding posts are spaced apart by a spacing being smaller than half a wavelength in air at the operating frequency.

* * * * *